US007502446B2

(12) United States Patent
Dotten et al.

(10) Patent No.: US 7,502,446 B2
(45) Date of Patent: Mar. 10, 2009

(54) SOFT X-RAY GENERATOR

(75) Inventors: Robert Dotten, Richmond (CA); Robert Taylor, Stittsville (CA); Emilio Panarella, Ottawa (CA); Meisheng Xu, Ottawa (CA); Yuriy Antoshko, Ottawa (CA); Ian Stanley Chapman, Gatineau (CA); Philippe P. Gratton, Gatineau (CA); David Johnson, Kars (CA)

(73) Assignee: ALFT Inc. (CA)

( * ) Notice: Subject to any disclaimer, the term of this patent is extended or adjusted under 35 U.S.C. 154(b) by 25 days.

(21) Appl. No.: 11/581,954

(22) Filed: Oct. 17, 2006

(65) Prior Publication Data

US 2007/0086572 A1 Apr. 19, 2007

Related U.S. Application Data

(60) Provisional application No. 60/727,881, filed on Oct. 18, 2005.

(51) Int. Cl.
*H01J 35/00* (2006.01)

(52) U.S. Cl. ..... 378/119

(58) Field of Classification Search ..... 378/119, 378/121, 125, 127, 130, 131, 141, 143, 144, 378/136

See application file for complete search history.

(56) References Cited

U.S. PATENT DOCUMENTS

| | | | | |
|---|---|---|---|---|
| 3,878,394 | A | 4/1975 | Golden | 378/102 |
| 3,970,884 | A | 7/1976 | Golden | 378/122 |
| 4,201,921 | A | 5/1980 | McCorkle | 378/122 |
| 4,210,813 | A | 7/1980 | Romanovsky et al. | 378/101 |
| 4,238,682 | A | 12/1980 | Vratny | 378/141 |
| 4,258,262 | A | 3/1981 | Maldonado | 378/141 |
| 4,577,340 | A | 3/1986 | Carlson et al. | 378/132 |
| 4,612,477 | A | 9/1986 | Dothan | 315/111 |
| 4,618,972 | A | 10/1986 | Georgiou et al. | 378/34 |
| 4,622,687 | A | 11/1986 | Whitaker et al. | 378/130 |
| 4,625,324 | A | 11/1986 | Blaskis et al. | 378/130 |
| 4,866,743 | A | 9/1989 | Kroener | 378/4 |
| 4,878,235 | A * | 10/1989 | Anderson | 378/136 |
| 4,928,296 | A | 5/1990 | Kadambi | 378/141 |
| 4,945,562 | A | 7/1990 | Staub | 378/130 |
| 5,054,046 | A * | 10/1991 | Shoulders | 378/119 |
| 5,442,677 | A | 8/1995 | Golden et al. | 378/102 |

(Continued)

FOREIGN PATENT DOCUMENTS

| | | |
|---|---|---|
| CA | 2241116 | 12/1999 |

(Continued)

*Primary Examiner*—Courtney Thomas
(74) *Attorney, Agent, or Firm*—Price, Heneveld, Cooper, DeWitt & Litton, LLP

(57) ABSTRACT

A soft x-ray generator includes a unique pulse trigger assembly which reliably and reproducibly provides a plasma to initiate the discharge between a cathode and an anode, and having a cone-shaped geometry. The soft x-ray generator of the present invention also includes a rotating anode which is generally disk-shaped with an outer circumferential edge which can be rotated with respect to the cathode to expose different sections of the anode to the plasma discharge, thereby reducing anode wear and providing longer term operation. Anode erosion is also reduced by the liquid cooling of the anode during use. The generator utilizes a relatively low capacitance for the cathode-to-anode discharge and a relatively high voltage and pulse repetition rate (frequency) to achieve continuous reproducible results.

41 Claims, 13 Drawing Sheets

U.S. PATENT DOCUMENTS

| | | | | |
|---|---|---|---|---|
| 5,469,490 | A | 11/1995 | Golden et al. | 378/122 |
| 5,651,045 | A | 7/1997 | Pouvesle et al. | 378/119 |
| 6,031,241 | A | 2/2000 | Silfvast et al. | 250/504 R |
| 6,240,163 | B1 | 5/2001 | Zhang et al. | 378/122 |
| 6,389,106 | B1 | 5/2002 | Neff et al. | 378/122 |
| 6,430,260 | B1 | 8/2002 | Snyder | 378/130 |
| 6,714,624 | B2 | 3/2004 | Fornaciari et al. | 378/119 |
| 6,804,327 | B2 | 10/2004 | Schriever et al. | 378/119 |
| 6,815,900 | B2 | 11/2004 | Ahmad et al. | 315/111.21 |
| 6,845,145 | B2 | 1/2005 | Selzer et al. | 378/34 |
| 6,894,298 | B2 | 5/2005 | Ahmad et al. | 250/504 R |
| 6,940,946 | B2 | 9/2005 | Kutschera | 378/130 |
| 6,946,669 | B2 | 9/2005 | Kleinschmidt | 250/504 R |
| 2004/0234033 | A1 | 11/2004 | Anno et al. | |

FOREIGN PATENT DOCUMENTS

| | | |
|---|---|---|
| EP | 0037917 | 10/1981 |
| JP | 61104599 | 5/1986 |
| JP | 61138436 | 6/1986 |
| JP | 61173496 | 8/1986 |
| JP | 61225798 | 10/1986 |
| JP | 61233998 | 10/1986 |

* cited by examiner

SOFT X-RAY GENERATOR

CROSS-REFERENCE TO RELATED APPLICATIONS

This application claims priority under 35 U.S.C. § 119(e) on U.S. Provisional Application No. 60/727,881, entitled Soft X-Ray Generator, filed on Oct. 18, 2005, by Robert (NMI) Dotten, et al., the entire disclosure of which is incorporated herein by reference.

BACKGROUND OF THE INVENTION

The present invention relates to improvements in a soft x-ray generator. U.S. Pat. No. 6,240,163 discloses a soft x-ray (also referred to as EUV) electromagnetic radiation source which provides improved short bursts of radiation in the about 75 ev to about 12 Kev range. These bursts of radiation have a maximum intensity for use in a variety of applications, including lithography, crystallography, and radiography, in the scientific, industrial, and medical fields. The disclosure of U.S. Pat. No. 6,240,163 is incorporated herein by reference. Although the system disclosed in the '163 patent represents a vast improvement over prior art soft x-ray generators, there remains a need for a system which has a longer useful life under continuous high frequency operating conditions by preventing, for example, erosion of the anode as well as having a more predictable and reliable trigger operation for initiating the discharge between the anode and cathode for such continuous operation.

SUMMARY OF THE INVENTION

The soft x-ray generator of the present invention satisfies these needs and provides additional benefits by including a unique pulse trigger assembly which reliably and reproducibly provides a plasma and initiates the discharge between a cathode and an anode. The trigger assembly has a cone-shaped geometry which implements gas discharge to provide efficient and reliable operation of the trigger. In one embodiment, the soft x-ray generator of the present invention includes a rotating anode which is generally disk-shaped with an outer circumferential edge which is rotated with respect to the cathode to expose different sections of the anode to the vacuum spark discharge, which produces the plasma, thereby reducing anode wear and providing longer term operation. Anode erosion is also reduced by liquid cooling of the anode. The generator of this invention utilizes a relatively low capacitance for the cathode-to-anode discharge and a relatively high pulse repetition rate (frequency) to achieve its continuous reproducible results.

These and other features, objects and advantages of the present invention will become apparent upon reading the following description thereof together with reference to the accompanying drawings.

DETAILED DESCRIPTION OF THE PREFERRED EMBODIMENT

Figure 1:
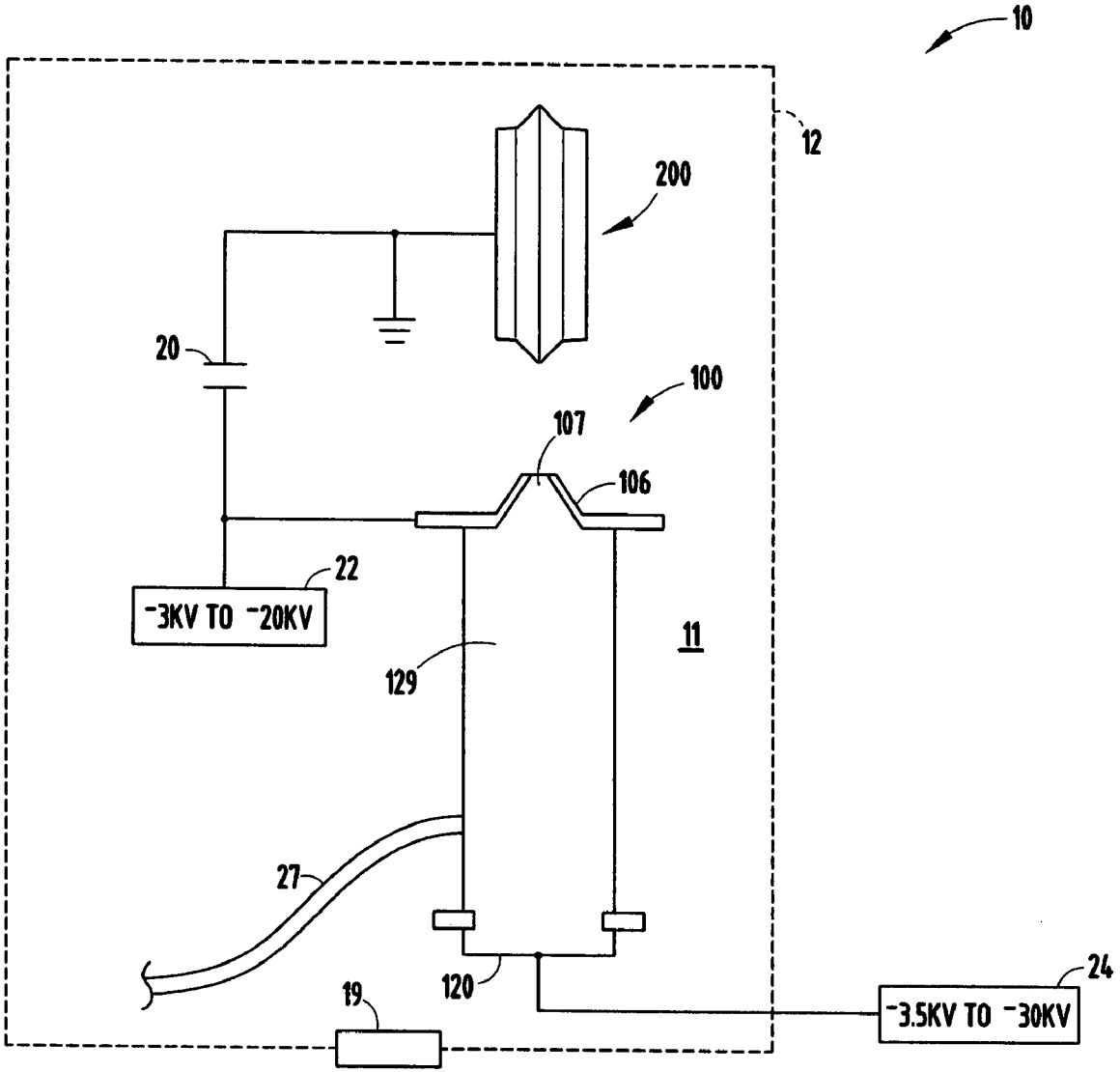
FIG. 1 is a schematic view of a soft x-ray generator embodying the present invention.

It should be understood that the invention is not limited to the details of the particular arrangement shown and described since the invention is capable of other embodiments. Materials and the parameters used herein are for the purpose of description not of limitation. Referring initially to FIG. 1, there is shown an x-ray generator 10 of the present invention, which includes an outer chamber 12 through which various power supplies, cooling conduits, a gas supply conduit 27, and a vacuum pump are sealably coupled in a conventional manner to supply operating voltage, an inert gas to the trigger electrode assembly via conduit 27, different cooling fluids to both the trigger assembly and rotating anode, as well as a vacuum for the interior 11 of the sealed chamber 12. The x-ray generator comprises in the preferred embodiment a trigger electrode assembly 100 and a rotating anode assembly 200, which are shown in detail in the various drawing figures of this application. Both of these assemblies are contained within the vacuum chamber interior 11, and one or more capacitor(s) 20 is/are coupled between the anode assembly 200 and trigger assembly 100 including cathode 106. The capacitor 20 is charged by a pulsed power source 22 at from about −3 kv to about −20 kv, depending upon the desired operation characteristics. Power source 22 is shown and described in FIG. 17. The capacitor is charged/discharged at a repetition rate which corresponds to the frequency of trigger operation of from about 1 Hz to about 100 kHz. The trigger electrode 100 is coupled to a trigger power source 24, which provides pulses at the same frequency with a voltage amplitude of from about −3.5 kv to about −30.0 kv.

Figure 2:
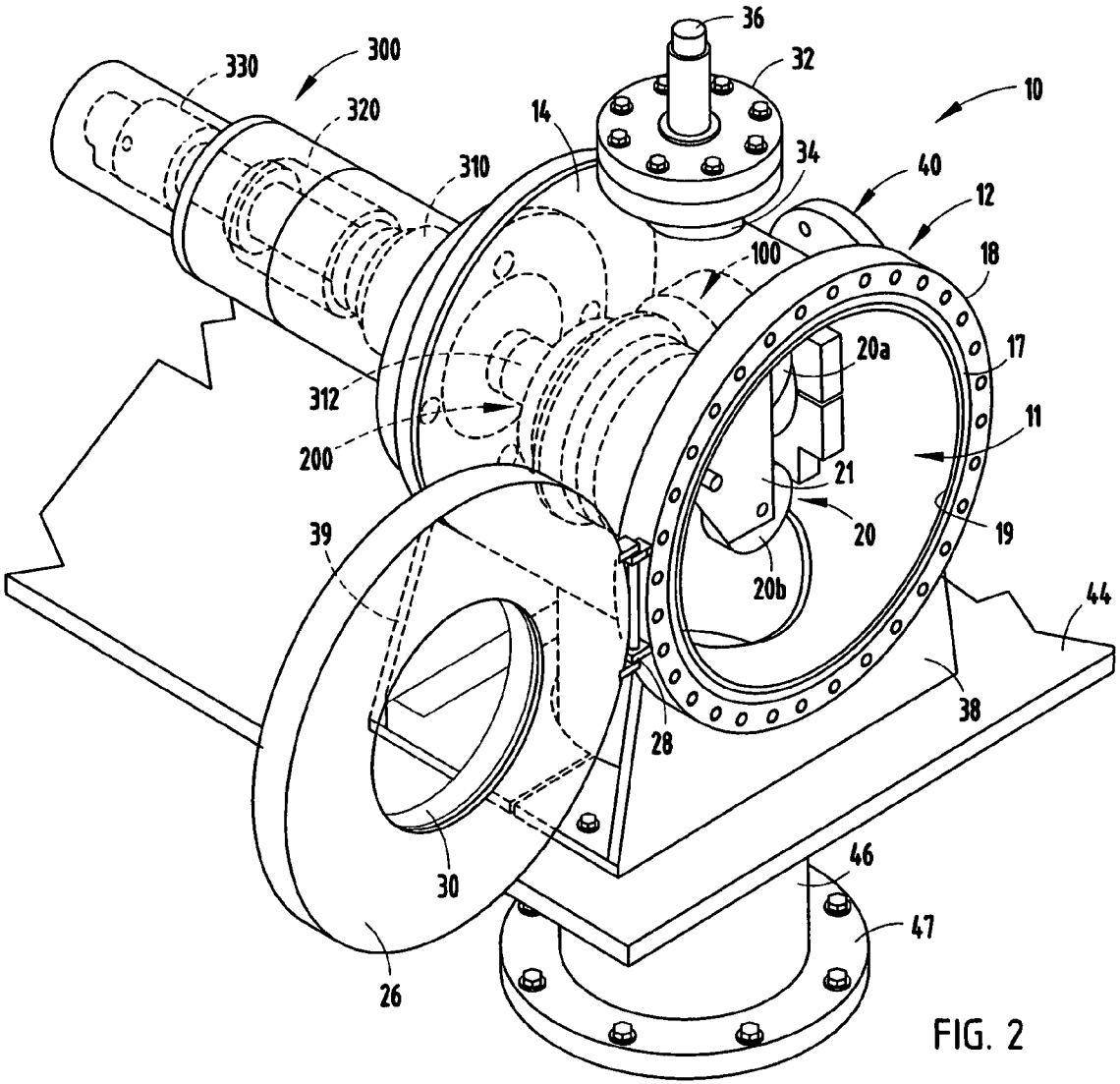
FIG. 2 is a perspective view, partly in phantom, of the soft x-ray generator housing and its components contained within the vacuum chamber shown in FIG. 1.
Figure 3:
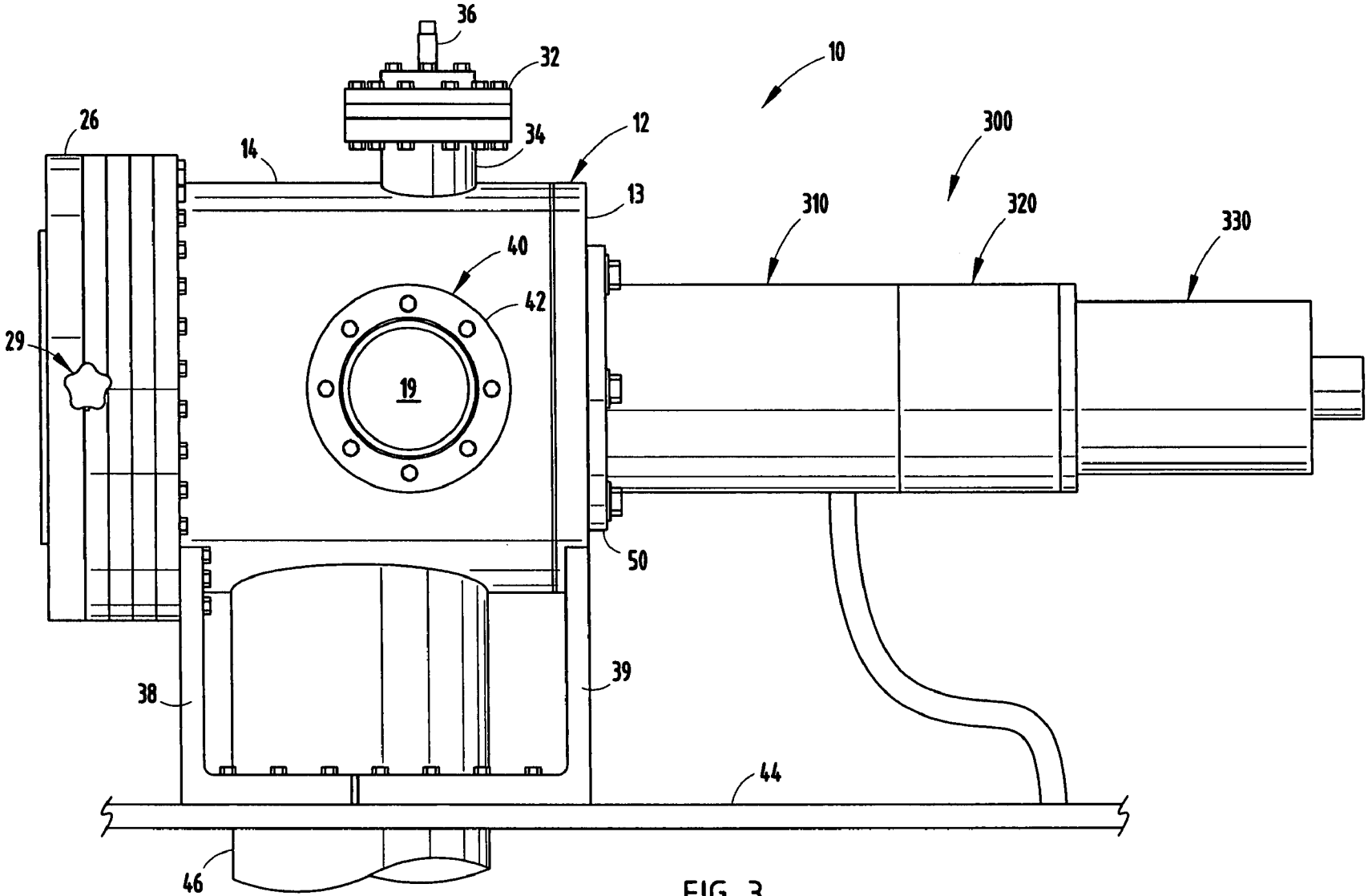
FIG. 3 is a right elevational view of the x-ray generator shown in FIG. 2.
Figure 4:
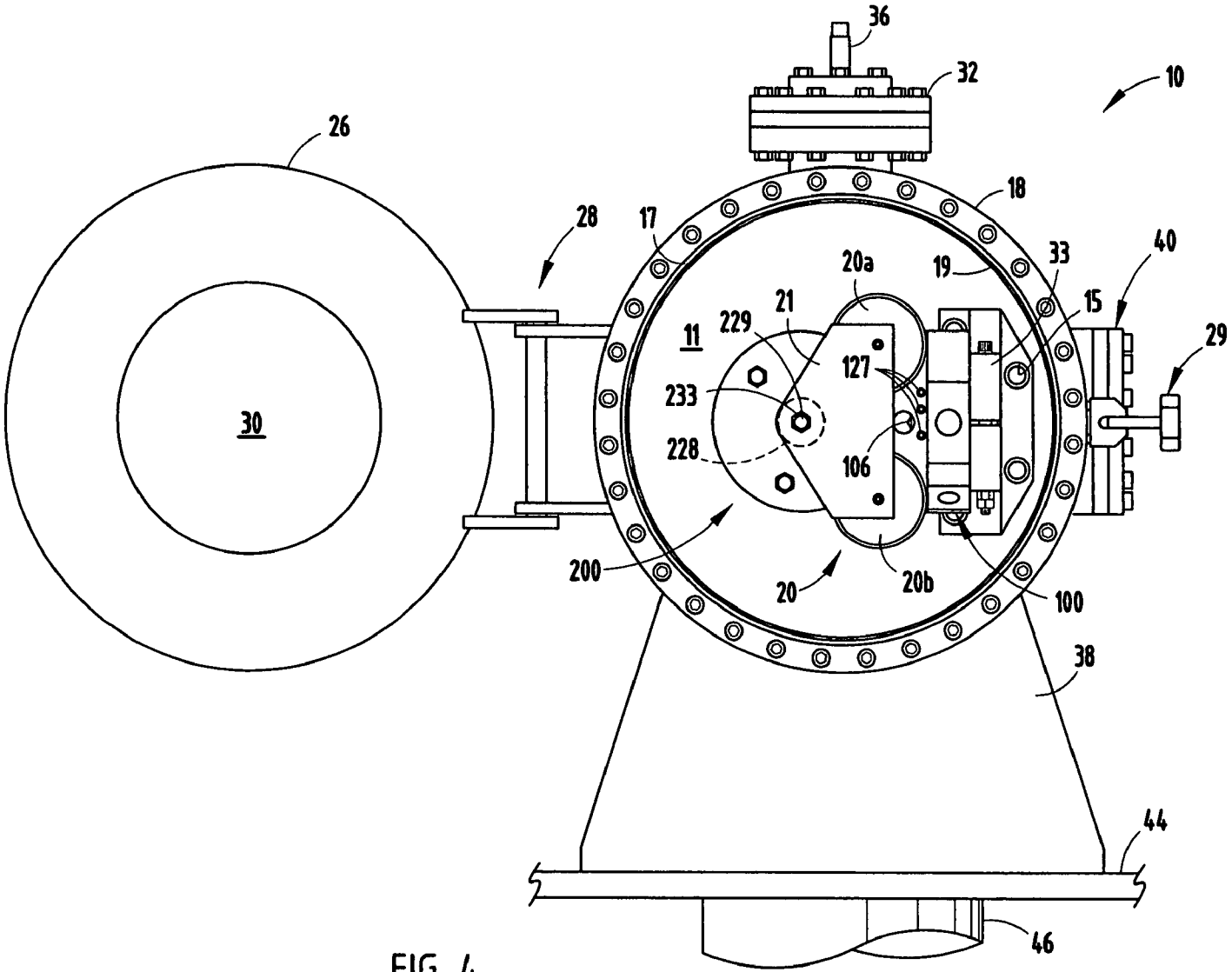
FIG. 4 is a front elevational view of the x-ray generator shown in FIGS. 2 and 3.

The overall geometry of the x-ray generator 10 and the chamber 12 housing the component parts is shown in FIGS. 2-4. Chamber 12 comprises a generally cylindrical body 14 having an annular flange 18 at one end which includes a sealing O-ring 17 for sealing the open end when engaged by a hinged circular door 26. In order to sealably clamp the door 26 in a closed, vacuum-tight seal with the chamber 12, a locking clamp assembly 29 of conventional design and including a rotary locking knob, as seen in FIGS. 3 and 4, is employed. Door 26 is hinged to flange 18 by a hinge 28 and includes a sealed window 30 so the interior 11 of the chamber can be viewed, either through the door 26 or through a viewing port comprising a flange 32 extending from a conduit 34 from body 14. The viewing port may include a pin diode 36 for observing the pulse discharge between the cathode and anode of the x-ray generator. Generator 10 also includes an exit port 40 (best seen in FIG. 3) which includes a window 19 where an x-ray filter can be installed. When a beryllium window 19 is employed, it typically has a thickness of from about 3 to about 20 microns, and preferably of from about 8 to about 10 microns, and is fairly transparent to the soft x-rays generated in chamber 11. The soft x-rays generated by the generator 10 pass through the window and can be applied to a device employing such x-rays through a mounting flange 42. Such devices may include instruments used for lithography, crystallography, radiography, and other scientific or medical appliances which benefit from the soft x-rays generated by generator 10.

Flange 42 and port 40 are also coupled to the cylindrical body 14 of chamber 12 through a cylindrical conduit which communicates with the cathode assembly as described below. Body 14 of chamber 12 is mounted by mounting brackets 38 and 39, which are coupled to cylindrical body 14 and are mounted to a base 44 which is supported by a suitable cabinet which accommodates the remainder of the components, including the power supplies, control circuit, and fluid and liquid supplies and pumps for the generator 10.

A relatively large cylindrical conduit 46 communicates with the interior space 11 of chamber 12 and is coupled to a high vacuum pump for evacuating the interior 11 of the chamber to achieve a vacuum of from about $10^{-4}$ to about $10^{-6}$ torr. Conduit 46 terminates in a flange 47 for coupling to the high vacuum pump (not shown).

Sealably coupled to the rear wall 13 (FIG. 3) of housing body 14 by means of a flange 50 is a motor assembly 300. Assembly 300 includes a vacuum bearing 360 in housing 310 (FIGS. 15 and 16), a motor housing 320, and a rotary cooling water supplying housing 330 described in greater detail below. Motor assembly 300 rotates a rotary drive shaft 312 coupled to the rotating anode 200 as well as provides cooling fluid, such as water, thereto. The components of the chamber 12 are suitably machined from stainless steel.

Figure 5:
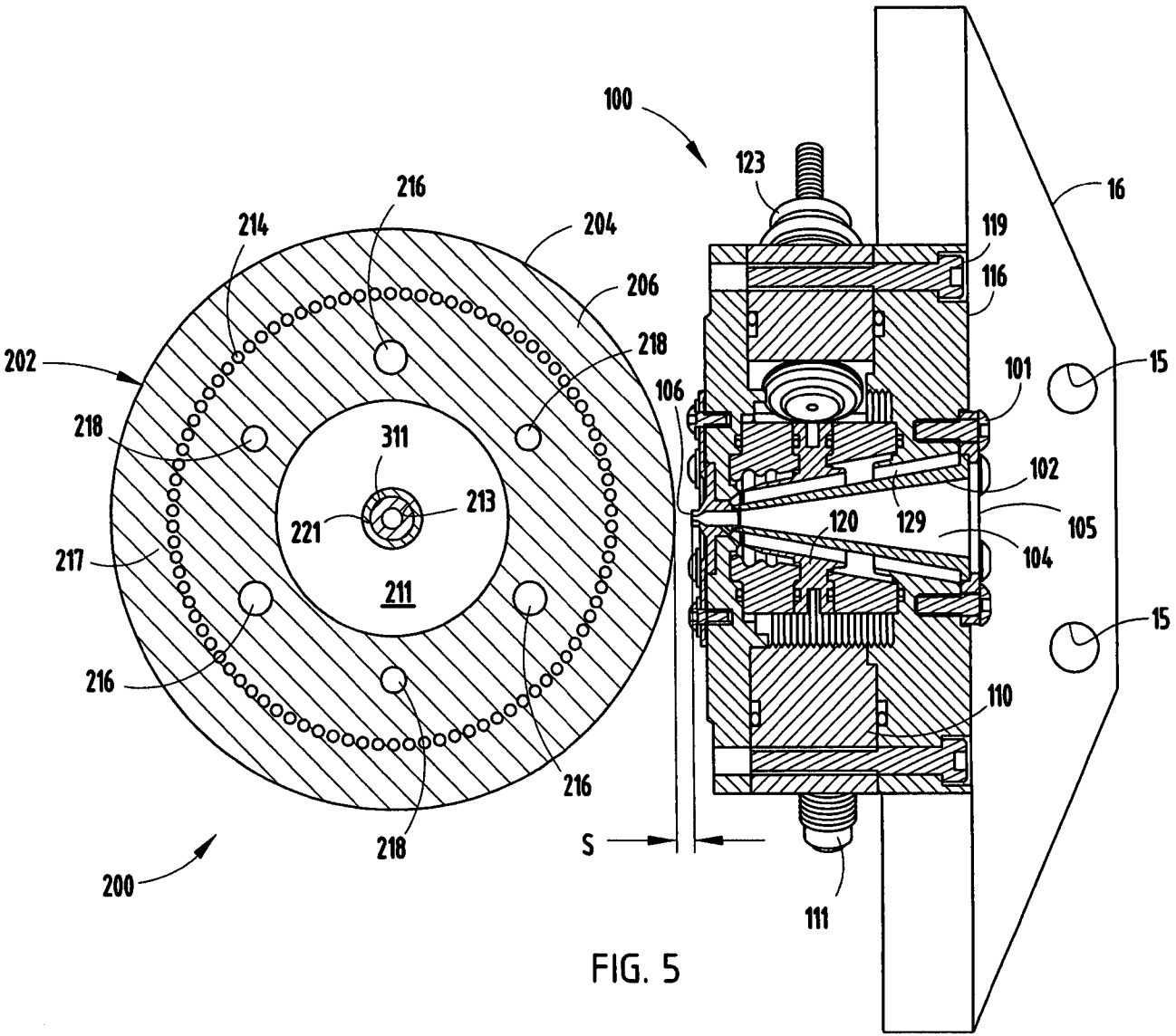
FIG. 5 is a cross-sectional view of the anode and trigger assembly shown in FIGS. 2 and 4.
Figure 6:
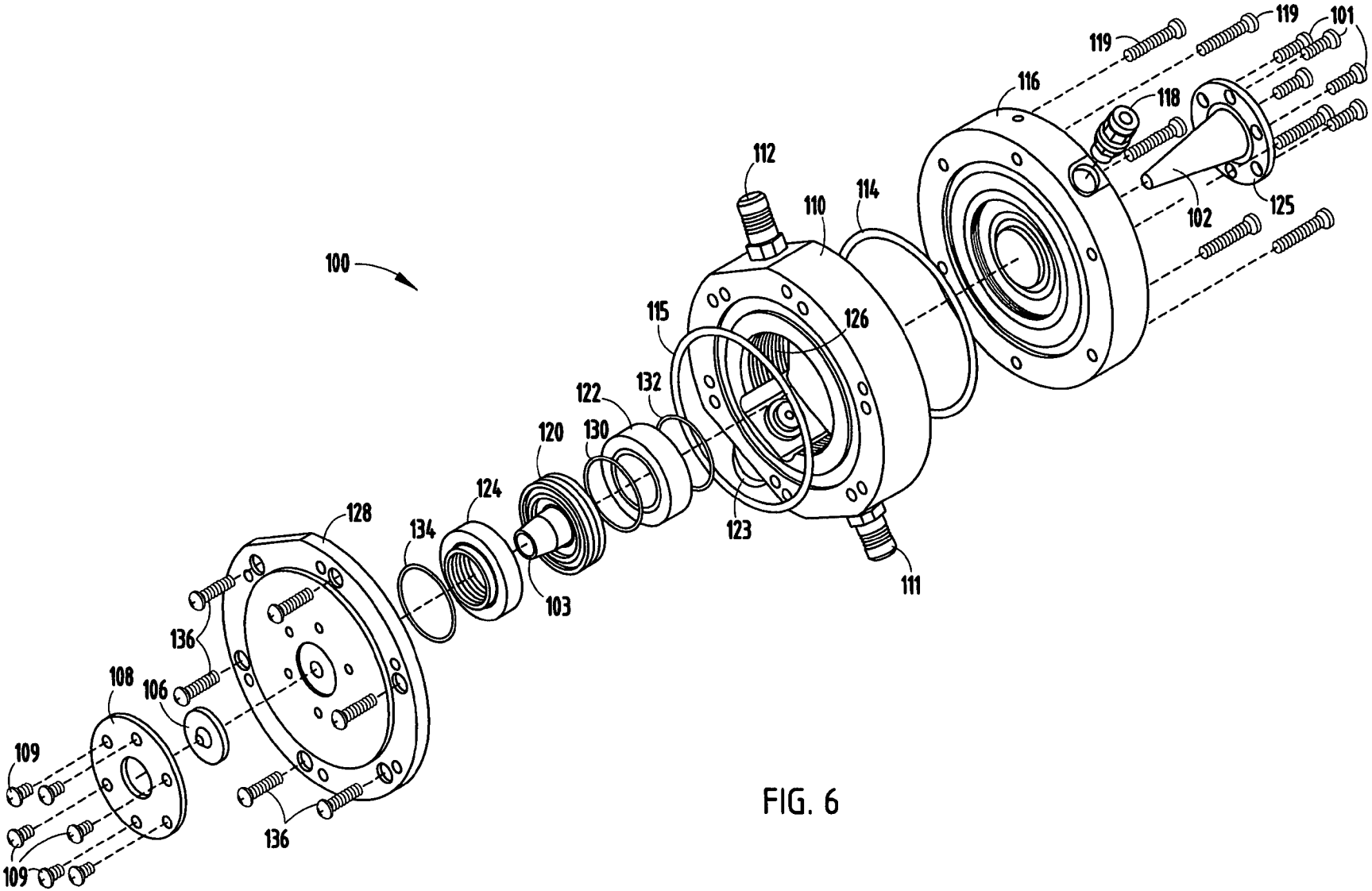
FIG. 6 is an exploded perspective view of the trigger assembly shown in FIG. 5.
Figure 7:
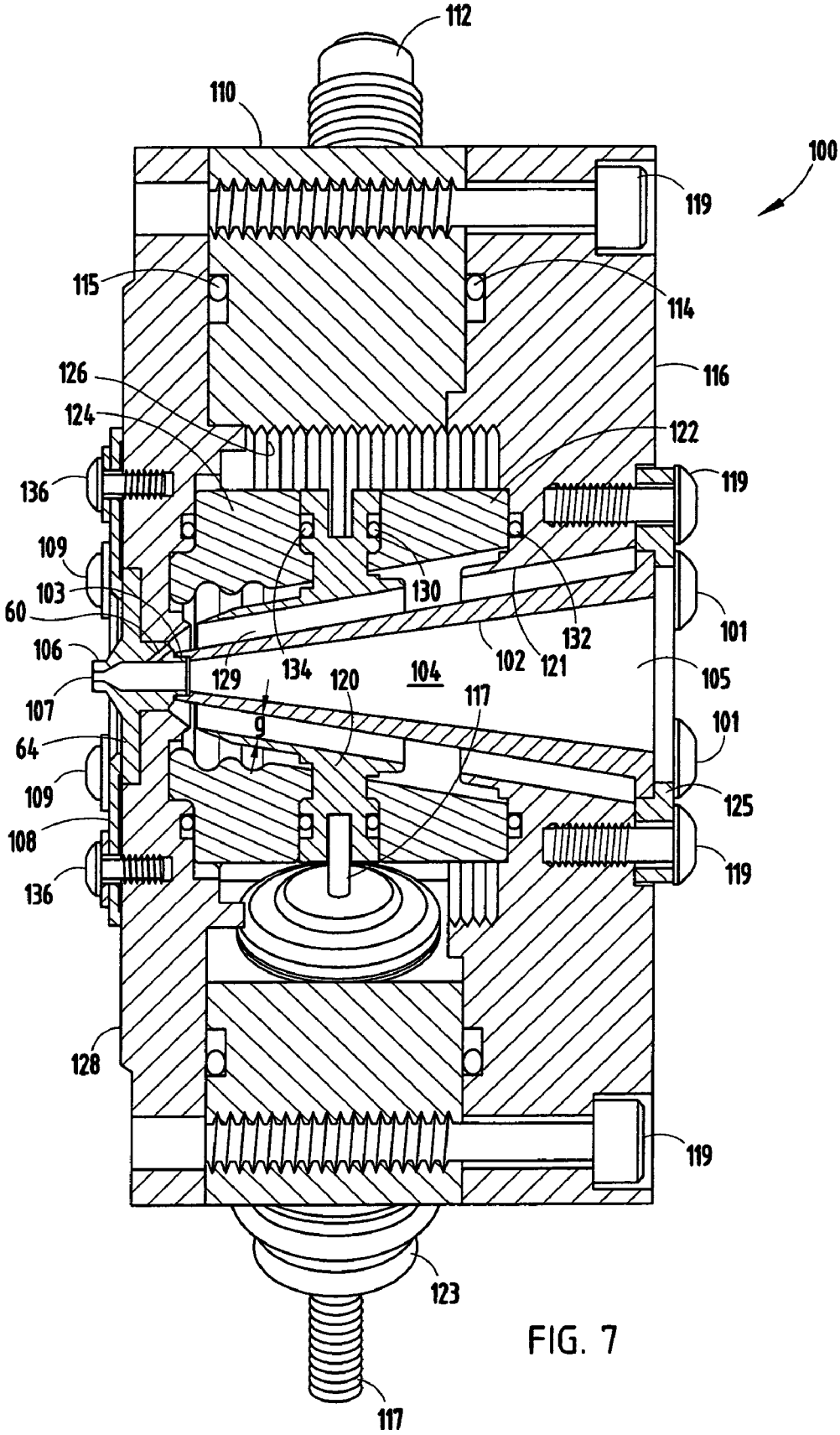
FIG. 7 is an enlarged cross-sectional view of the assembled trigger assembly shown in FIG. 5.
Figure 8:
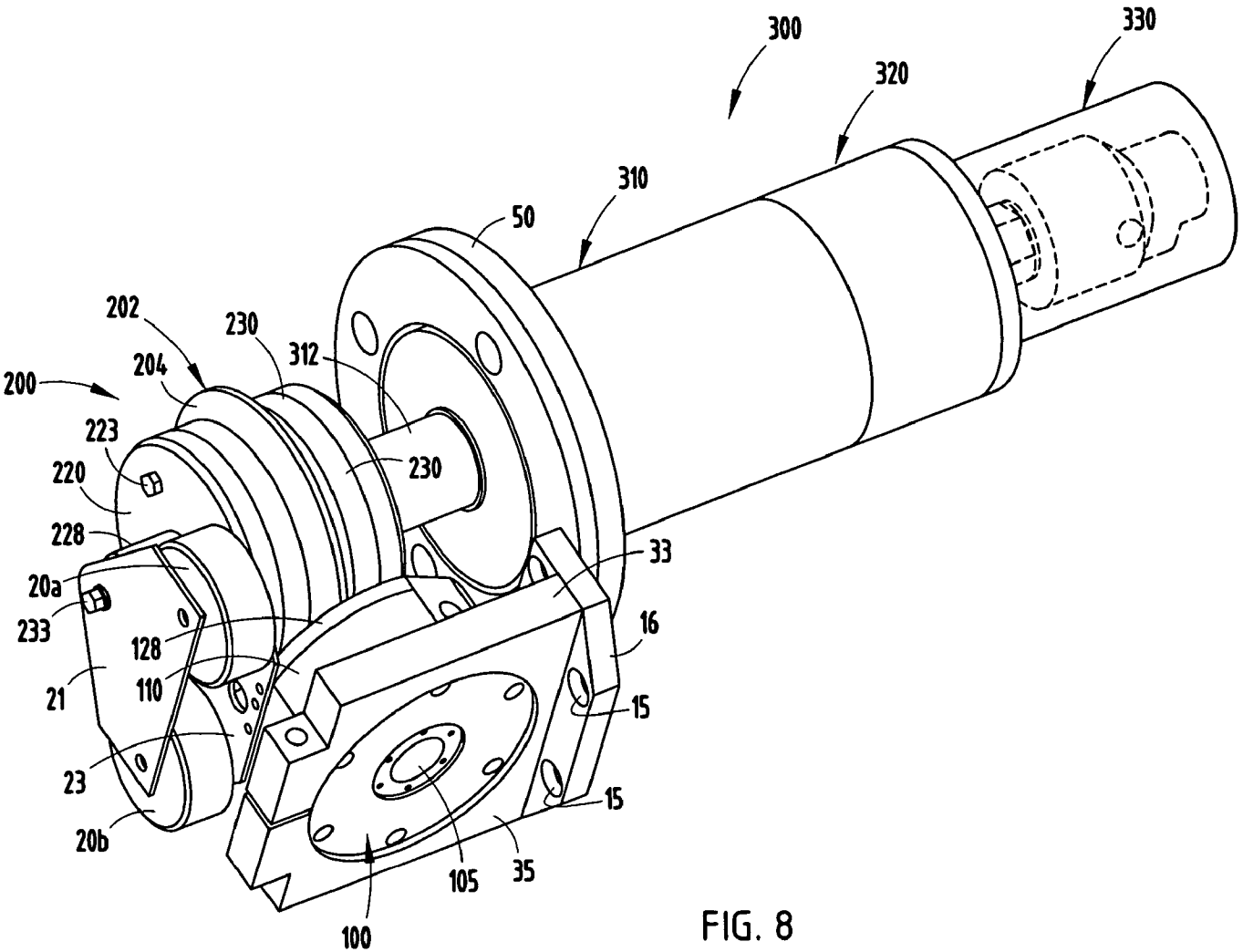
FIG. 8 is a perspective view of the anode assembly, the motor assembly, and the trigger assembly removed from the chamber.
Figure 10:
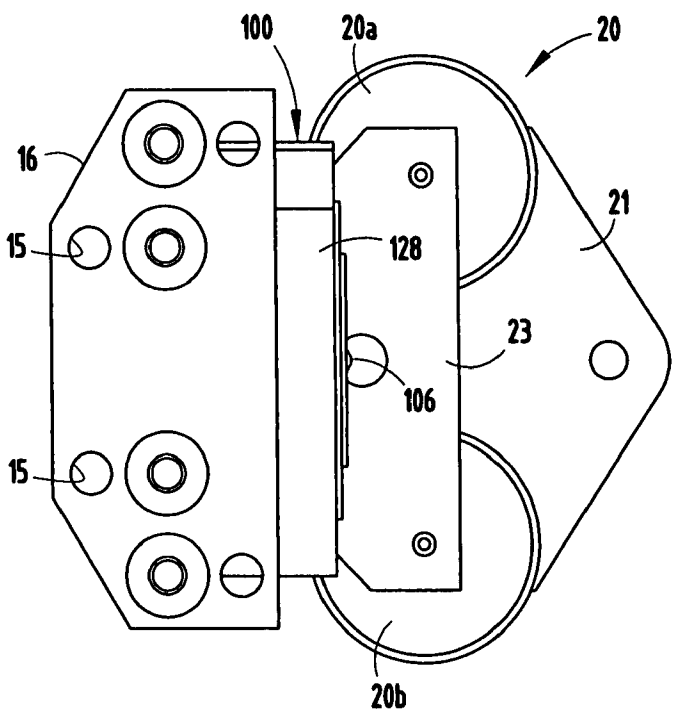
FIG. 10 is a rear elevational view of the cathode assembly.
Figure 9:
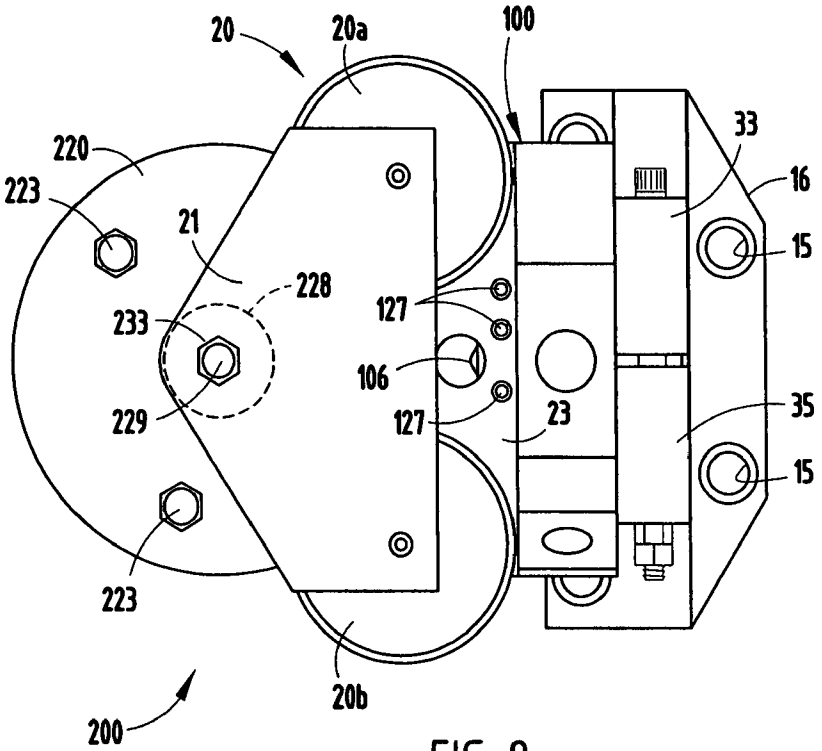
FIG. 9 is a front elevational view of the anode and trigger assemblies.
Figure 13:
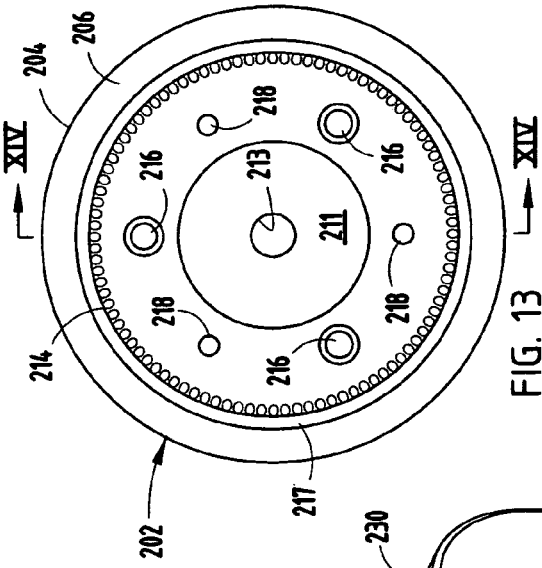
FIG. 13 is a front elevational view of the rotating anode shown in FIG. 12.
Figure 17:
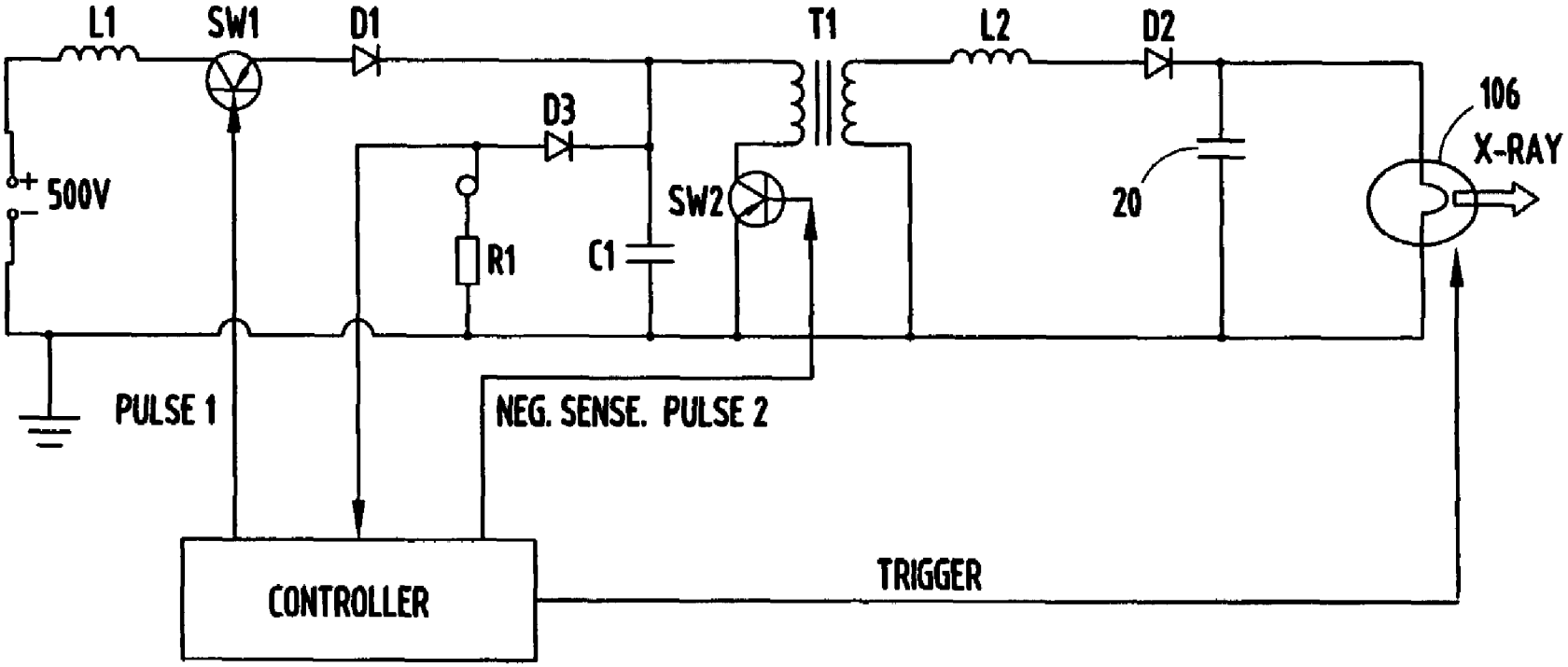
FIG. 17 is an electrical circuit diagram, in schematic form, of a high voltage power supply used with the soft x-ray generator of the present invention.

The trigger assembly 100 is shown in detail in FIGS. 5-7 and is mounted in insulated relationship to chamber body 14 within space 11 (FIG. 2) and adjacent rotating anode assembly 200 in the relationship also seen in FIGS. 4, 5, and 8. Between the rotating anode 200 and the cathode 106 of trigger assembly 100, there is mounted one or more capacitors 20 between spaced-apart mounting plates 21 and 23 for providing a capacitance of from about 1 nano-farad to about 1 micro-farad depending upon the desired operational characteristics of the system. Capacitor 20 comprises a pair of generally disk-shaped capacitors 20*a* and 20*b* coupled in parallel (FIGS. 9, 10 and 17).

Trigger assembly 100 includes a generally annular trigger electrode 120, which concentrically surrounds cone-shaped member 102 having a tip 103 engaging cathode 106, as best seen in FIG. 7. Electrode 120 and cone-shaped member 102 define a cone-shaped gas-filled chamber 129, as best seen in FIGS. 5 and 7. Nozzle 106 also includes a cone-shaped exit aperture 107. The negative voltage from source 24 (FIG. 1) is applied between the trigger electrode 120 and cone 102 and causes the ionization of the inert gas within the trigger chamber 129 between them and produces a plasma and free electrons. The gas typically can be an inert gas, such as argon or the like, or other kinds of gases, e.g. nitrogen or mixtures supplied to chamber 129. When the gas discharge occurs in the chamber, the free electrons and the plasma diffuse through the holes 60 (FIGS. 7 and 7A) and the open tip 107 of the cathode nozzle 106 into the gap between the cathode and anode toward the grounded anode assembly 200. The electrons are accelerated by the electric field provided by the applied high voltage between the cathode and anode from the pulsed power source 22. When the electrons impinge upon the anode, an anode plasma is generated of the copper anode material (although other anode materials can be employed), which diffuses toward the cathode. Upon the meeting of both plasmas, the discharge of capacitor(s) 20 between the grounded anode and negative high voltage cathode is initiated. During the discharge process, electric current increases rapidly in nano seconds and, due to the current pinching effect, a plasma region of small size is formed between the cathode and anode where the plasma is increasing in temperature, and the copper ions and atoms in the plasma are multiple ionized. This results in the generation of soft x-rays of point source size which exit through exit port or window 105 (FIGS. 5 and 7) of the trigger electrode assembly 100 into chamber 12. Chamber 12 may include several radiation transparent windows, such as window 19, to allow the soft x-rays generated between the cathode and rotating anode to be externally focused and employed for a variety of applications.

The relationship of the trigger assembly 100 to the anode assembly 200 is seen in FIGS. 5 and 8, with the cathode structure also shown in FIG. 2, being mounted within the chamber 12 by, in part, a phenolic insulator plate 16 which includes apertures 15 for mounting the cathode assembly in insulative relationship to rear wall 13 of chamber body 14. A pair of brackets 33 and 35 (FIG. 8) extend from insulator 16 and clamp the trigger housing 110 in place. Conductive plate 23 (FIGS. 8-10) is coupled to capacitors 20*a*, 20*b* and is secured to the housing 110 of trigger assembly 100, as seen in FIG. 8. As described below, the remaining conductive plate 21 is coupled to the opposite side of capacitors 20*a*, 20*b* and a conductive end bearing 228 of the rotary anode assembly 200. Having briefly described the main components of the system and its operation, a detailed description of the geometry of the trigger assembly, and, subsequently, the rotating anode assembly is now provided in connection with FIGS. 5-7.

The trigger assembly is best seen in FIGS. 5-7 and includes a fluid (such as oil) cooled trigger housing 110 which includes an annular, finned oil-cooling channel 126 formed therein surrounding and facing the trigger electrode 120. The cooling channel is supplied with cooling fluid, such as oil, through an inlet 111 and an outlet 112 which provides a flow path through the sealed housing for the admission of cooling oil, which is cooled externally of chamber 11. An oil inlet hose (not shown) supplies cooled oil to inlet 111 of housing 110 while an oil outlet hose (not shown) returns the heated oil from outlet 112 through a sealed coupling in the chamber conduit 46 to be cooled externally.

A trigger housing rear cover 116 is sealably mounted to trigger housing 110 by means of fasteners 119 and a sealing O-ring 114. Cover 116 includes an inert gas inlet 118 for the admission of an inert gas into the interior of chamber 129 defined by the sealed assembly. The negative voltage applied to the trigger electrode 120 is applied through a conductor 117 in insulator 123. Conductor 117 extends through trigger housing 110 (FIG. 7) and is coupled to the ring-shaped trigger electrode 120. The trigger voltage is applied through (FIG. 7)

which is extended to the ring-shaped trigger electrode 120 for applying a relative pulsed negative voltage between cathode 106 and electrode 120 of from about −0.5 kv to about −10 kv.

Figure 7A:
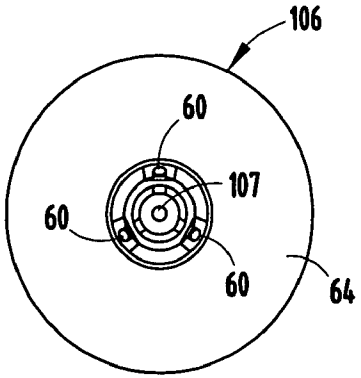
FIG. 7A is a front view of the cathode.

Trigger electrode 120 is insulated from the housing 110 by a rear insulator 122, a front insulator 124, and insulator 123, all of which are mounted in sealable engagement within the trigger chamber 104 by a series of O-rings 130, 132, and 134. An O-ring 115 sealably couples the trigger front cover 128 to the trigger housing 110 and is held in place by suitable fasteners, such as fasteners 136 (FIGS. 6 and 7). The cathode trigger nozzle 106 (forming the cathode) is secured to the trigger front cover 128 by means of a nozzle retaining disk 108 and suitable fastening screws 109 secured within threaded apertures in the front mounting plate 128. A slight gap "g" of from about 0.010 inch to about 0.150 inch exists between the cone 102 and trigger electrode 120. When the high voltage is applied via conductor 117 between trigger electrode 120 and cone 102, a plasma is formed within chamber 129, which communicates with the vacuum chamber 11 through one or more radially spaced apertures 60 in the cathode, as best seen in FIG. 7A. The apertures 60, as also shown in FIG. 7, communicate between chamber 129 and the opening 107 of the cathode nozzle 106, which includes an annular mounting flange 64, as seen in FIG. 7A, to facilitate its mounting, as shown in FIG. 7, to the front mounting plate 128. In one preferred embodiment of the invention, the apertures 60 were equally spaced at 120° intervals and had a diameter of approximately 0.030 inch with a nozzle opening 107 having an inner diameter of 0.040 inch. In some applications, a greater or fewer number of equally spaced apertures 60 may be provided to feed the plasma contained within conical chamber 129 to the exit aperture 107 of cathode 106. When the plasma is formed within the chamber 129 of trigger electrode assembly 100, therefore, the plasma is drawn by the negative pressure in chamber 11 outwardly through aperture 107 toward the rotating anode assembly 200 and to the edge 204 (FIGS. 5 and 8) of the anode 202 (described below) with spacing "s" (FIG. 5) from about 1 mm to about 6 mm between the tip of cathode 106 and the aligned edge 204 of anode 202.

A perspective view of the assembled trigger assembly 100 is shown in FIG. 8, which illustrates the mounting of the capacitors 20*a* and 20*b* with one mounting plate 23 being secured by fasteners 127 (FIG. 9) to the edge of trigger front cover 128 and the remaining mounting plate 21 supporting the rotating anode assembly 200 through a conductive bearing as described below.

Figure 14:
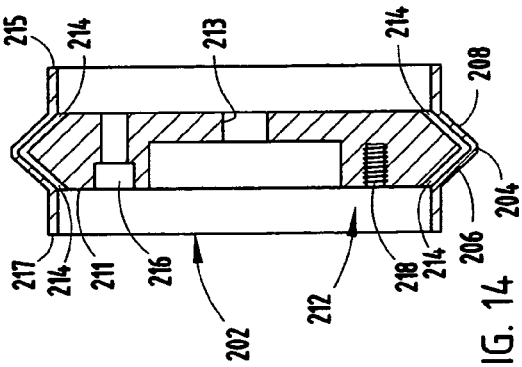
FIG. 14 is a cross-sectional view, taken along section lines XIV-XIV of FIG. 13, of the rotating anode shown in FIGS. 1, 2, and 13.
Figure 11:
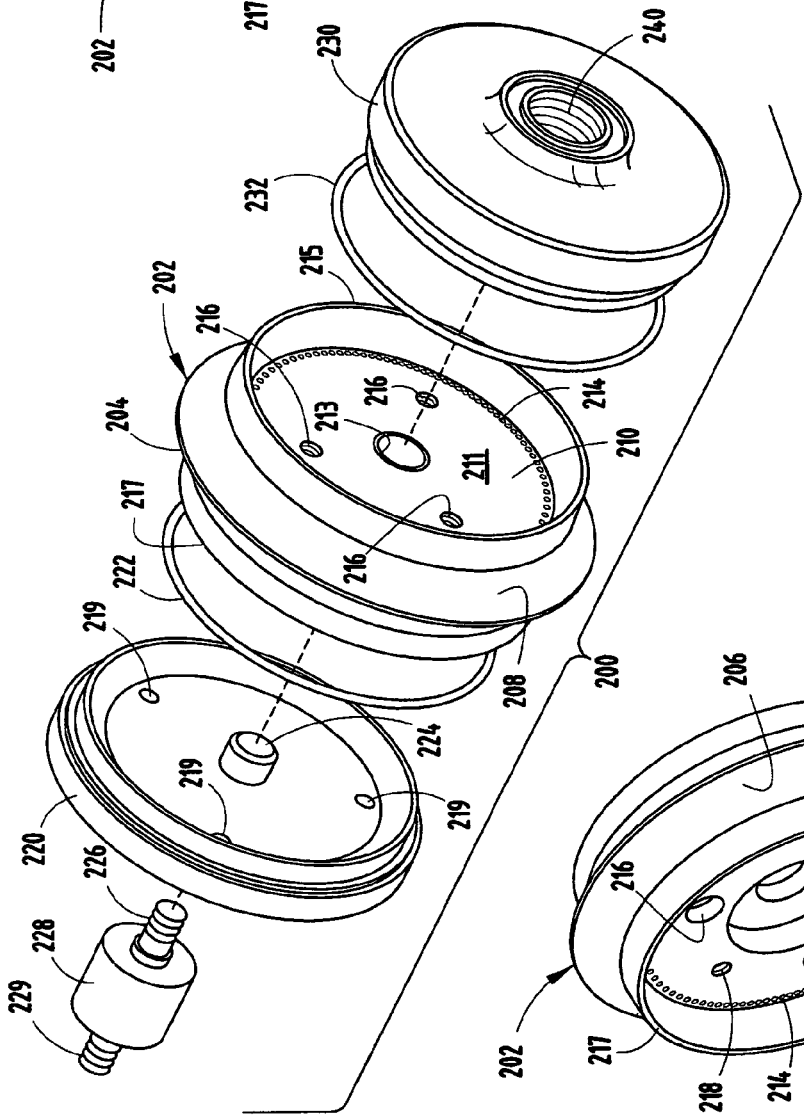
FIG. 11 is an exploded perspective view of the rotating anode assembly shown in FIGS. 1, 2, 5, and 8.
Figure 12:
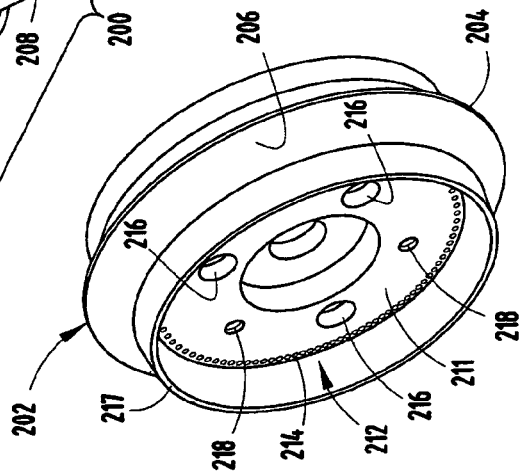
FIG. 12 is a perspective view of the anode shown in FIG. 4.

The trigger assembly includes a second cone 102 spaced from the conical interior walls 121 (FIG. 7) of the oil-cooled rear housing 116 and main housing 110. Cone 102 also remains relatively hot and is not affected by the oil-cooled housing and further prevents debris from clogging the aperture in cone 102 adjacent cathode 106. The beryllium window 19 typically has a thickness of from about 3 to about 20 microns and preferably of from about 8 to about 10 microns and is fairly transparent to the soft x-rays generated in chamber 11. The window 105 is held in place on the open aperture of rear housing 116 by an annular mounting ring 125 which is held in place by threaded fasteners 101. Having described the trigger assembly, a description of the rotating anode assembly is now provided in connection with FIGS. 5, 8, and 10-16. Rotating anode assembly 200 comprises a generally circular disk-shaped anode 202 made of copper or other suitable metal, which, as best seen in FIG. 14, has an outer peripheral edge 204 formed at the flattened tip of the intersecting, converging walls 206 and 208 of the body of anode 202. Anode 202 includes a concave depression 210 defined by a peripheral rim 215 on one side and a similar concave depression 212 defined by peripheral rim 219 on the opposite side separated by a central disk-shaped wall 211. Anode 202 is sealably held between a cup-shaped first end wall 220 and a second cup-shaped end wall 230, which extend within rims 219, 215 (FIG. 16), respectively, and are sealed thereto by means of O-rings 222 and 232, respectively. End wall 230 includes a threaded aperture 240 for receiving the threaded end 311 (FIG. 15) of hollow drive shaft 312. Cooling fluid, such as water, is introduced as described below through a supply conduit 332 concentric within hollow drive shaft 312 and can flow within the chamber defined by cavities 210, 212 between members 220 and 230 through central opening or aperture 213 in wall 211. For such cooling, a plurality of spaced-apart apertures 214 (FIGS. 11-14) are formed at angles which follow and are parallel to the converging walls 206, 208 and are spaced inwardly therefrom. The apertures 214 have an inner diameter of about 0.113 inch and their location therefor provides a flow path for coolant immediately adjacent edge 204. the apertures 214 extend around the peripheral edge of wall 211 of anode 202 and extend toward the edge 204 to promote the flow of the water from cavity 212 under pressure through aperture 213 through apertures 214 into cavity 210 to maintain the anode at an operating temperature well below what normally would be encountered. The walls 206, 208 converge at about 45° forming an angle of about 90° at edge 204. The thickness of the generally triangular peripheral edge where walls 206, 208 join the body 211 is about 0.5 inch. The anode is positioned, as best seen in FIGS. 5 and 8, with the edge 204 being spaced, as noted above, from about 1 mm to about 6 mm from the tip of cathode trigger nozzle 106, such that the plasma drawn through aperture 107 bombards the highly charged edge 204 of the anode to form the metallic ions, which subsequently gather to form a pinch zone, and the generation of soft x-rays, as discussed above. In one embodiment, anode 202 had an outer diameter of about 4.9 inches, although other diameter anodes may be employed.

End walls 220, 230 of the sealed hollow anode assembly 200 are attached to the anode 202, which includes three equally spaced recessed apertures 216 for receiving cap screws which thread into three equally spaced threaded apertures 217 (FIG. 16) on the inner surface of end wall 230 to attach the anode to wall 230. The anode, in turn, includes three equally spaced interspersed threaded apertures 218 which receive hex bolts 223 (FIGS. 9 and 16) for attaching end wall 220 to anode 202 in sealed engagement therewith. End wall 220 includes a blind mounting boss 224 which is internally threaded to receive the threaded axle end 226 (FIG. 16) of a conductive bearing 228 which is mounted to plate 21. Bearing 228 includes an internally threaded stub axle 229 which receives and is secured to plate 21 by means of a threaded nut 233. Thus, the axle 226 is allowed to rotate with respect to the fixed body 228 and stub axle 229 of the conductive bearing, as also illustrated in FIG. 8. Having described the anode assembly 200 and its rotatable mounting at one end to the stationary grounded plate 21, a description of the rotating drive shaft 312 and its mounting to body 14 of the outer chamber 12 of x-ray generator 10 is now described in connection with FIGS. 15 and 16.

Figure 15:
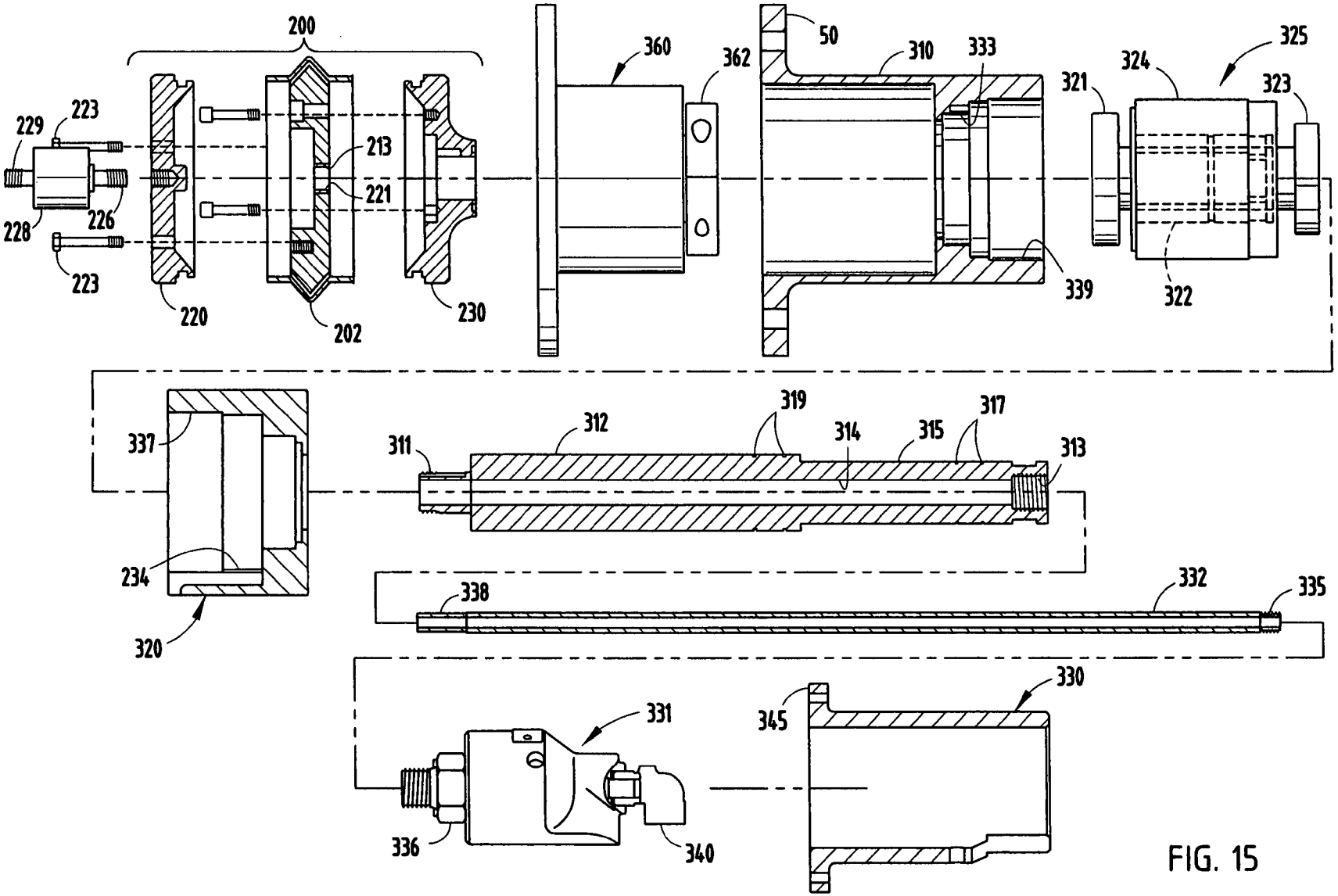
FIG. 15 is an exploded view of the drive and cooling system for the anode.
Figure 16:
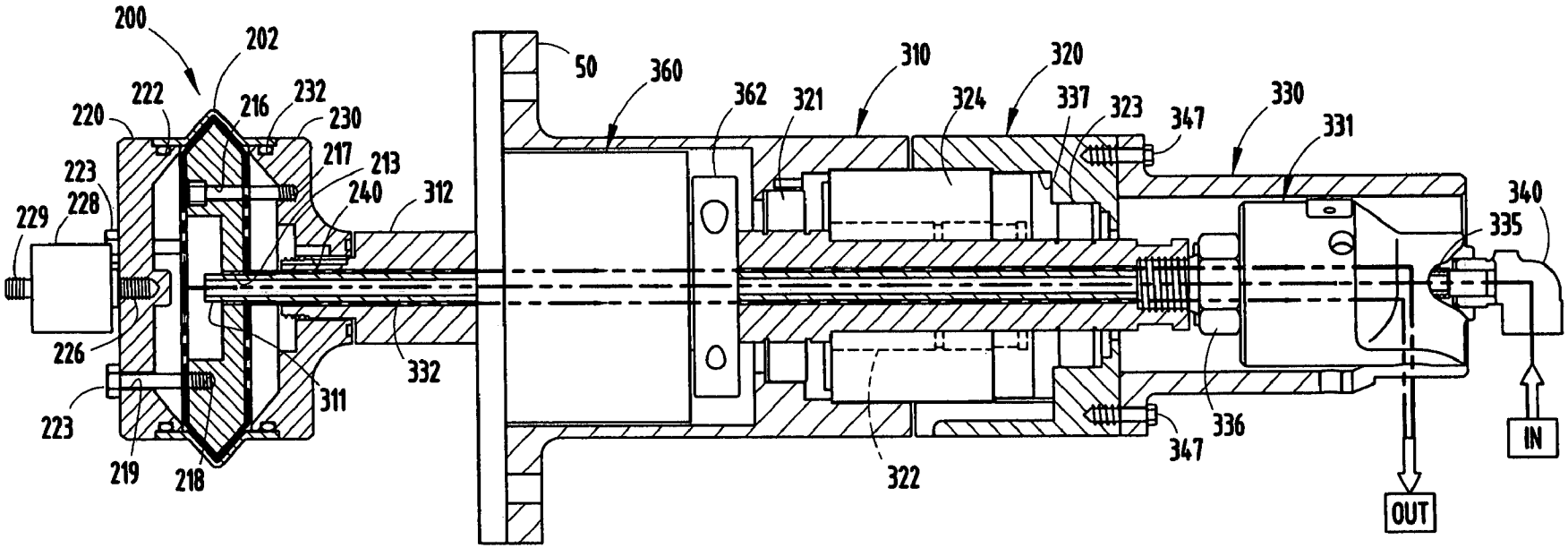
FIG. 16 is a vertical cross-sectional view of the assembled structure of FIG. 15.

The drive system for the rotary drive shaft 312 coupled to the rotating anode assembly 200 is now described in connection with FIGS. 15 and 16. The assembly 300 is employed for not only rotating the anode 202 at a speed of up to about 1500 rpm but also to supply a cooling fluid, such as water, to the anode 202 through the hollow drive shaft 312. The supply of fluid can be tap water and the return drained, or, in some applications, a loop of coolant can be employed and the heated coolant returned to a chiller for recirculation. This is accomplished by the structure shown in FIGS. 15 and 16, which includes the hollow drive shaft 312 having a central, longitudinally extending aperture 314 for receiving in spaced concentric relationship the cooling fluid supply tube 332. Shaft 312 includes a threaded end 313 for receiving a rotatable fitting 336 of a water supply union 331 as shown in FIG. 16. The drive shaft 312 also is splined along the area 315 to center the motor rotor 322, which includes a stater 324. Rotor 322 is mounted between bearings 321 and 323 and affixed to shaft 312 in area 315 with epoxy within recess 333 of housing 310 at one end and to recess 334 in motor housing section 320. Drive shaft 312 also includes circumferential snap-ring apertures 317 for receiving snap rings for securing bearings 321 and 323 in longitudinal alignment with shaft 312. The diameter of shaft 312 increases toward end 311 as it extends through a ferrule fluidic bearing, which is commercially available, for example, from Ferrotec Corporation Model No. HS-1500-SLFBC. This vacuum bearing 360 is mounted within housing 310 and is held in place by a clamp 362, which rotates with shaft 312. Shaft 312 also includes circumferentially extending snap ring apertures 319 for holding bearing 321 in longitudinal alignment with shaft 312. Stater 324 of the axially aligned motor 325 fits within a recess 339 of housing 310 and 337 of housing 320, as seen in FIG. 16.

The coolant supply tube 332 has a first threaded end 335 which threadably extends into the union 331, as illustrated in FIG. 16, and receives cooling fluid, such as water, through an inlet connector 340. The stationary concentric tube 332 is held in longitudinally spaced alignment with an annular space between the outer diameter of tube 332 and the inner diameter of aperture 314 of rotary drive shaft 312 by its coupling to union 331 at one end and the extension through aperture 213 in anode 202, which includes a conventional bushing 221 (FIGS. 5 and 15) between the end 338 of supply tube 332 and aperture 213 as necessary. Union 331 is a commercially available rotating union manufactured, for example, by the Deublin Company of Northbrook, Ill. in their Model 57 Series. The flange 345 of housing 330 receives fasteners, such as bolts or cap screws 347 (FIG. 16), which extend through housing 320 and into housing 310 in a conventional manner for securing housings 330, 320, and 310 together, while other suitable fasteners, such as hex bolts or the like, extend through the apertures in flange 50 for securing the assembly 300 to the body 14 of chamber 12.

The negative power supply 22 (FIG. 1) for the capacitor(s) 20 charges the capacitor(s) at a rate at least as fast, if not slightly faster, than the pulse trigger voltage frequency. The power supply should have the same frequency as the trigger pulse rate. They are synchronized by the controller (FIG. 17), such that there is a time delay between the two signals. The main pulse is first to charge the capacitor(s) to the given voltage, followed by the trigger pulse, such that, as soon as the trigger discharges the plasma within chamber 129 of the trigger assembly, the fully charged capacitor 20 discharges through the plasma in the gap "s" (FIG. 5) between the anode edge 204 and cathode 106 effecting generation of soft x-rays within chamber 11. The x-rays are then transmitted from the trigger assembly through the x-ray filters at window 19 or exit port 40 transparent to the x-ray radiations of the x-ray generator. Chamber 11 may have a plurality of similar windows, such as window 19 (FIG. 1), at various locations around the housing 12, for the exit of soft x-rays which can be focused external to generator 10 for subsequent use in lithography, crystallography, radiography, or the like, in a conventional manner.

In order to achieve a high repetition rate of discharge, fast charging of capacitors C1 and 20 to about −3 kv to about −20 kv from a 500 volt DC (FIG. 17) source is required. A two stage resonant charging circuit is employed for this, as schematically shown in FIG. 17. The first stage resonantly charges capacitor C1 to 1000 volts through inductor L1, and the second stage resonantly charges capacitor 20 from capacitor C1 through inductor L1 using the step up transformer T1. The pulser is able to signal the controller (which includes a microprocessor) that a short circuit shunts 20 inside the vacuum chamber by sensing a negative voltage on C1. The controller stops to pulse the pulser to prevent potential damage of charging circuitry. To achieve high and controlled repetition rates of vacuum discharge for desired output power, a flexible design of controller and pulser module that can control and deliver high repetition rates up to 100 kHz is desirable. To obtain multiple charging rates from a single pulser circuit, multiplexing multiple pulsers are employed.

It will become apparent to those skilled in the art that various modifications to the preferred embodiment of the invention as described herein can be made without departing from the spirit or scope of the invention as defined by the appended claims.

The invention claimed is:

1. An x-ray generator comprising:

a vacuum chamber housing an anode assembly; and a trigger assembly including a cathode, wherein said cathode includes a cone-shaped nozzle with an exit aperture facing said anode; and a trigger electrode mounted in insulative relationship to said nozzle.

2. The x-ray generator as defined in claim 1 wherein said trigger electrode is annular.

3. The x-ray generator as defined in claim 2 and further including a cone mounted in spaced insulative relationship to said trigger electrode to define a plasma chamber between said cone and said trigger electrode, wherein said cone has an interior volume.

4. The x-ray generator as defined in claim 3 wherein said cathode includes at least one additional aperture extending between said exit aperture and said plasma chamber.

5. The x-ray generator as defined in claim 4 wherein said plasma chamber is generally conical.

6. The x-ray generator as defined in claim 5 wherein said exit aperture communicates with the volume within said cone.

7. The x-ray generator as defined in claim 6 and further including a drive for rotating said anode with respect to said cathode associated with the trigger assembly to expose different sections of the anode to the cathode during operation of the x-ray generator, wherein said drive includes a supply of liquid coolant for said anode and said anode includes converging outer walls terminating at an edge facing said cathode and said anode includes coolant apertures extending in parallel spaced relationship to said outer walls.

8. The x-ray generator as defined in claim 7 wherein said anode is generally disk-shaped with said edge facing said cathode.

9. The x-ray generator as defined in claim 8 wherein said anode assembly includes a pair of cup-shaped end plates sealably enclosing opposite sides of said anode and defining an interior volume.

10. The x-ray generator as defined in claim 9 wherein said apertures extending from one side of said anode to an opposite side through said anode in the area of said outer walls to allow cooling fluid to flow through said outer walls.

11. The x-ray generator as defined in claim 10 including a source of cooling fluid coupled to said interior volume of said anode assembly and wherein said source of cooling fluid includes a hollow drive shaft coupled to said anode assembly for rotating said anode and an inner coolant supply conduit for supplying coolant fluid to said interior volume and a concentric outer conduit between said inner coolant supply conduit and drive shaft for providing an annular passageway for the exhaust of coolant from said interior volume for allowing cooling fluid to flow into said interior volume and be exhausted therefrom.

12. The x-ray generator as defined in claim 11 and further including a drive motor for rotating said drive shaft and wherein said drive shaft and coolant supply conduit extend through a rotor of said drive motor and are coupled to a rotating coolant supply union.

13. A soft x-ray generator comprising:

a chamber housing an anode assembly including an anode, a trigger assembly mounted in spaced relationship to said anode assembly, and including a cathode;

a drive for rotating said anode with respect to said cathode associated to expose different sections of the anode to the cathode during operation of the x-ray generator, wherein said drive includes a supply of liquid coolant for said anode and said anode includes converging outer walls terminating at an edge facing said cathode and converging coolant apertures extending in parallel spaced relationship to said outer walls.

14. The soft x-ray generator as defined in claim 13 wherein said anode is generally disk-shaped with said edge facing said cathode.

15. The soft x-ray generator as defined in claim 14 wherein said anode assembly includes a pair of cup-shaped end plates sealably enclosing opposite sides of said anode and defining an interior volume.

16. The soft x-ray generator as defined in claim 15 wherein said apertures extending from one side of said anode to an opposite side through said anode in the area of said outer edge to allow cooling fluid to flow though said outer walls adjacent said edge.

17. The soft x-ray generator as defined in claim 16 including a source of cooling fluid coupled to said interior volume of said anode assembly and wherein said source of cooling fluid includes a hollow drive shaft coupled to said anode assembly for rotating said anode and an inner coolant supply conduit for supplying coolant fluid to said interior volume and a concentric conduit between said inner coolant supply conduit and drive shaft for providing an annular passageway for the exhaust of coolant from said interior volume for allowing cooling fluid to flow into said interior volume and be exhausted therefrom.

18. The soft x-ray generator as defined in claim 17 and further including a drive motor for rotating said drive shaft and wherein said drive shaft and coolant supply conduit extend through a rotor of said drive motor and are coupled to a rotating coolant supply union.

19. A soft x-ray generator comprising:

a vacuum chamber housing an anode assembly including an anode;

a trigger assembly mounted in spaced relationship to said anode assembly within said chamber and including a cathode;

a drive for rotating said anode with respect to said cathode associated with said trigger assembly to expose different sections of said anode to said cathode during operation of the x-ray generator; and said trigger assembly has a cone-shaped member with a narrowed end coupled to said cathode.

20. The soft x-ray generator as defined in claim 19 wherein said trigger assembly includes an annular trigger electrode surrounding and spaced from said cone-shaped member.

21. The soft x-ray generator as defined in claim 20 wherein the space between the exterior of said cone-shaped member and the interior of said trigger electrode defines a plasma-forming chamber.

22. The soft x-ray generator as defined in claim 21 wherein said cathode includes a cone-shaped nozzle with an exit aperture facing said anode.

23. The soft x-ray generator as defined in claim 22 wherein said cathode includes at least one aperture coupling said exit aperture with said chamber.

24. A soft x-ray generator comprising:

a vacuum chamber made of a conductive material;

an anode assembly including an anode electrically coupled to said chamber;

a trigger assembly mounted to said vacuum chamber in insulative spaced relationship to said anode assembly, said trigger assembly including a cathode;

a discharge capacitor coupled between said anode and said cathode; and a mounting plate electrically coupled to said chamber, to one plate of said discharge capacitor, and to said anode for supporting said anode.

25. The soft x-ray generator as defined in claim 24 and further including a drive for rotating said anode with respect to said cathode associated with the trigger assembly to expose different sections of the anode to the cathode during operation of the x-ray generator.

26. The soft x-ray generator as defined in claim 25 wherein said anode includes an axle extending toward said mounting plate and said mounting plate includes a bearing for rotatably supporting said anode.

27. The soft x-ray generator as defined in claim 26 wherein said anode assembly includes a pair of cup-shaped end plates sealably enclosing opposite sides of said anode and defining an interior volume.

28. The soft x-ray generator as defined in claim 27 including a source of cooling fluid coupled to said interior volume of said anode assembly and wherein said source of cooling fluid includes a hollow drive shaft coupled to said anode assembly for rotating said anode and an inner coolant supply conduit for supplying coolant fluid to said interior volume and a concentric conduit between said inner coolant supply conduit and drive shaft for providing an annular passageway for the exhaust of coolant from said interior volume for allowing cooling fluid to flow into said interior volume and be exhausted therefrom.

29. The soft x-ray generator as defined in claim 28 and further including a drive motor for rotating said drive shaft and wherein said drive shaft and coolant supply conduit extend through a rotor of said drive motor and are coupled to a rotating coolant supply union.

30. A soft x-ray generator comprising:

a vacuum chamber housing an anode assembly; and a trigger assembly including a cathode, wherein said cathode includes a cone-shaped nozzle with an exit aperture facing said anode; and an annular trigger electrode mounted in insulative relationship to said nozzle.

31. The soft x-ray generator as defined in claim 30 wherein said trigger electrode is annular.

32. The soft x-ray generator as defined in claim 31 and further including a cone mounted in spaced insulative relationship to said trigger electrode to define a plasma chamber between said cone and said trigger electrode, wherein said cone has an interior volume.

33. The soft x-ray generator as defined in claim 32 wherein said cathode includes at least one additional aperture extending between said exit aperture and said plasma chamber.

34. The soft x-ray generator as defined in claim 33 wherein said plasma chamber is generally conical.

35. The soft x-ray generator as defined in claim 34 wherein said exit aperture communicates with the volume within said cone.

36. The soft x-ray generator as defined in claim 35 and further including a drive for rotating said anode with respect to said cathode associated with the trigger assembly to expose different sections of the anode to the cathode during operation of the x-ray generator, wherein said drive includes a supply of liquid coolant for said anode and said anode includes converging outer walls terminating at an edge facing said cathode and said anode includes coolant apertures extending in parallel spaced relationship to said outer walls.

37. The soft x-ray generator as defined in claim 36 wherein said anode is generally disk-shaped with said edge facing said cathode.

38. The soft x-ray generator as defined in claim 37 wherein said anode assembly includes a pair of cup-shaped end plates sealably enclosing opposite sides of said anode and defining an interior volume.

39. The soft x-ray generator as defined in claim 38 wherein said apertures extending from one side of said anode to an opposite side through said anode in the area of said outer walls to allow cooling fluid to flow through said outer walls.

40. The soft x-ray generator as defined in claim 39 including a source of cooling fluid coupled to said interior volume of said anode assembly and wherein said source of cooling fluid includes a hollow drive shaft coupled to said anode assembly for rotating said anode and an inner coolant supply conduit for supplying coolant fluid to said interior volume and a concentric outer conduit between said inner coolant supply conduit and drive shaft for providing an annular passageway for the exhaust of coolant from said interior volume for allowing cooling fluid to flow into said interior volume and be exhausted therefrom.

41. The soft x-ray generator as defined in claim 40 and further including a drive motor for rotating said drive shaft and wherein said drive shaft and coolant supply conduit extend through a rotor of said drive motor and are coupled to a rotating coolant supply union.

* * * * *